United States Patent [19]

Kawaharazuka et al.

[11] Patent Number: 4,552,100

[45] Date of Patent: Nov. 12, 1985

[54] THROTTLE LEVER DEVICE OF POWER-DRIVEN BACKPACK TYPE MACHINE

[75] Inventors: Yukio Kawaharazuka, Ageo; Giichi Iida, Tokyo, both of Japan

[73] Assignee: Kioritz Corporation, Tokyo, Japan

[21] Appl. No.: 669,446

[22] Filed: Nov. 8, 1984

[30] Foreign Application Priority Data

Nov. 17, 1983 [JP] Japan ..... 58-176750[U]

[51] Int. Cl.[4] ..... F02B 63/00

[52] U.S. Cl. ..... 123/2; 123/198 R

[58] Field of Search ..... 123/398, 395, 198 R, 123/198 L, 400, 198 DB, DIG. 3; 239/152–154; 415/122 R, 124; 440/84, 87, 900

[56] References Cited

U.S. PATENT DOCUMENTS

| | | | |
|---|---|---|---|
| 2,682,248 | 6/1954 | Sitz | 440/87 |
| 3,421,697 | 1/1969 | Marks | 239/152 |
| 3,586,238 | 6/1971 | Schmierer et al. | 239/152 |

FOREIGN PATENT DOCUMENTS

| | | | |
|---|---|---|---|
| 57-20526 | 3/1982 | Japan | 123/198 R |
| 24383 | 7/1984 | Japan . | |

*Primary Examiner*—William A. Cuchlinski, Jr.

*Attorney, Agent, or Firm*—Karl W. Flocks; Sheridan Neimark

[57] ABSTRACT

In a power-driven backpack type machine including a main body having an internal combustion engine serving as a power source, a throttle lever device including a boss pivotably connected to one side of the main body an arm extending from the boss, and a throttle lever supported at a forward end of the arm for controlling the operation of the internal combustion engine. Locking means is provided for selectively lockingly securing the boss to the main body in a position in which the arm is upright and substantially parallel to the vertical longitudinal axis of the main body and in a position in which the arm extends forwardly of the main body. Resilient pressing means forces the boss against the main body with an adjustable biasing force which is adjusted by adjusting means.

1 Claim, 2 Drawing Figures

THROTTLE LEVER DEVICE OF POWER-DRIVEN BACKPACK TYPE MACHINE

BACKGROUND OF THE INVENTION (1.) Field of the Invention

This invention relates to a throttle lever device of a power-driven backpack type, machine such as a power blower of the backpack type, a power sprayer of the backpack type, etc., which uses an internal combustion engine as a power source.

(2.) Description of the Prior Art

Generally, a power-driven backpack type machine, such as a power blower, is usually provided with a throttle lever for controlling the operation of the internal combustion engine which is connected to a front end of an arm extending forwardly from one side of a main body, so that the operator can readily actuate the throttle lever. However, in the power-driven backpack type machine, the engine is secured to the main body in a position in which the arm supporting the throttle lever projects forwardly. Because of this structural arrangement, the conventional power-driven backpack type machine has suffered disadvantages. One of them is that a relatively large space is required for storing or transporting the machine, making it expensive to handle such machine. Also, when the machine happens to tumble, the throttle lever might suffer damage. To avoid this trouble, it has hitherto been usual practice to remove the throttle lever when the machine is transported. This has caused a delay in starting an operation when the machine has reached the destination.

SUMMARY OF THE INVENTION

Object of the Invention

This invention has been developed for the purpose of obviating the aforesaid disadvantages of the prior art. Accordingly, the invention has as its object the provision of a throttle lever device of a power-driven backpack type machine which is easy to handle and operate and convenient to use.

Statement of the Invention

According to the invention, there is provided, in a power-driven backpack type machine including a main body having an internal combustion engine serving as a power source, a throttle lever device comprising a boss pivotably connected to one side of the main body, an arm extending from the boss, a throttle lever supported at a forward end of the arm for controlling the operation of the internal combustion engine, locking means for selectively lockingly securing the boss to the main body in a position in which the arm is upright and substantially parallel to the vertical longitudinal axis of the main body and in a position in which the arm extends forwardly of the main body, resilient pressing means for forcing the boss against the main body with adjustable biasing force, and adjusting means for adjusting the biasing force exerted by the resilient pressing means.

By virtue of the aforesaid features of the invention, the space occupied by the machine and the volume of the machine can be minimized by moving the arm to the position in which it is upright and substantially parallel to the vertical longitudinal axis of the main body, when the machine is stored or transported. The arm can be positively locked in place in different positions, and damage to the throttle lever which might otherwise be caused when the machine tumbles can be readily avoided.

DETAILED DESCRIPTION OF THE INVENTION

The invention will now be described in detail by referring to an embodiment shown in the accompanying drawings.

Figure 1:
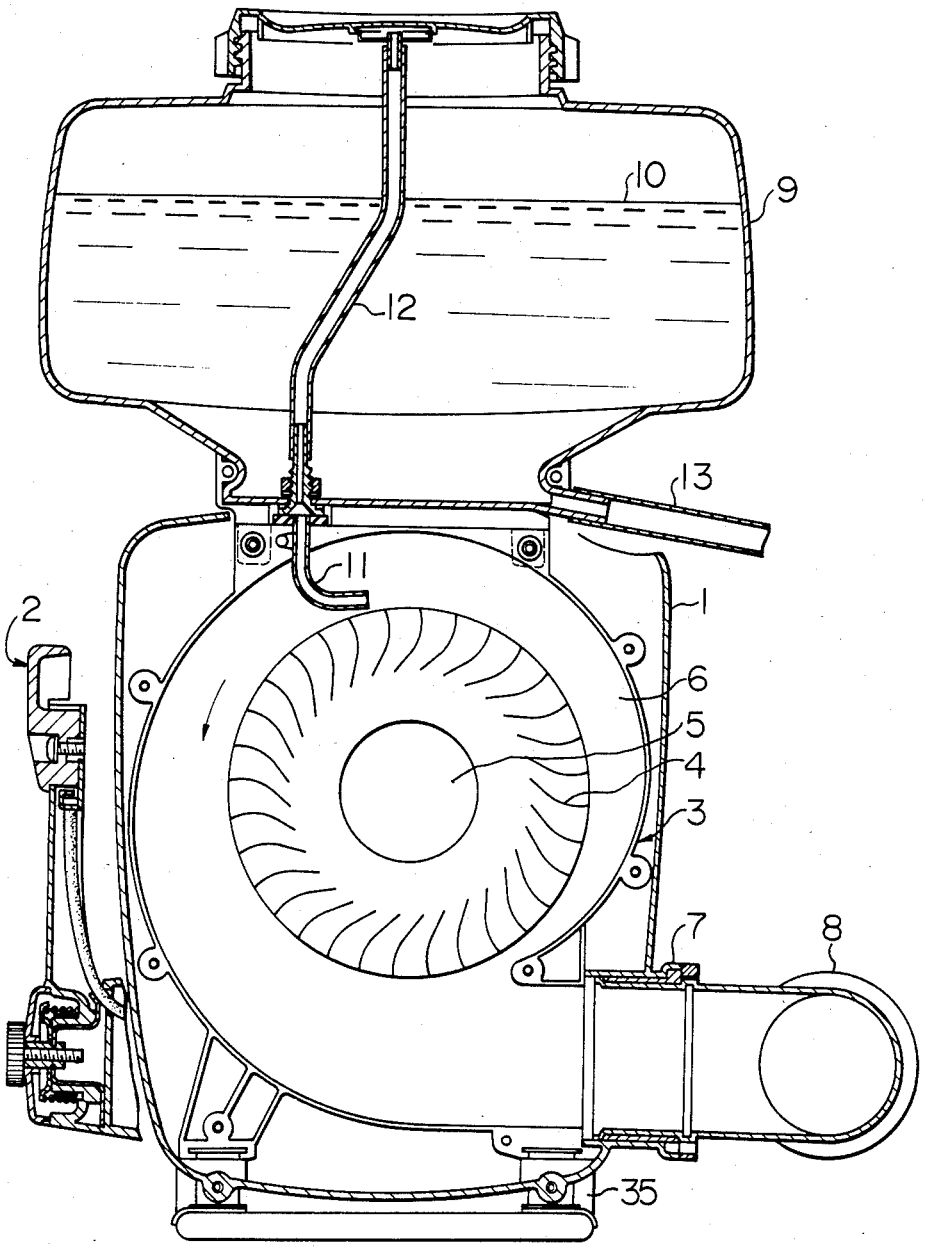
FIG. 1 is a vertical sectional view of a power sprayer device shown as an example of the power-driven backpack type machine in which the throttle lever device according to the invention is incorporated.

FIG. 1 shows a power sprayer device which is one of the power-driven backpack type machines, comprising a main body 1, and means 35 of known type for carrying the device on the back of an operator which is located in the front of the main body 1 or on an end face thereof disposed beyond the plane of FIG. 1, so that an operator can carry the device on the back while an operation is performed for spraying liquid chemical agent in atomized particles. Mounted inside the main body 1 is a small internal combustion engine, not shown, of a suitable type which serves as a power source. One embodiment of the throttle lever device in conformity with the invention which is generally designated by the reference numeral 2 is mounted to a lower portion of one side of the main body 1. A blower 3 is mounted in the main body 1 and comprises an impeller 4 connected to the internal combustion engine and driven thereby for rotation, a central air suction port 5 for drawing air therethrough, a volute casing 6 in which air drawn through the central air suction port 5 is pressurized, and an outlet port 7 through which the pressurized air is discharged from the volute casing 6. The outlet port 7 opens to outside at a side of the main body 1 opposite the one side at which the throttle lever device 2 is located. A curved tube 8 is removably connected to the outlet port 7, so that the pressurized air can be ejected through a forward end of the curved tube 8 in the form of an air current.

A liquid tank 9 is supported on the main body 1 and stores liquid chemical agent 10 to be sprayed in atomized particles. Secured to the main body 1 is an air extracting line 11 for extracting a portion of the pressurized air through a lower end from the volute casing 6 of the blower 3. An air line 12 having a lower end aligned with and connected to an upper end of the air extracting line 11 extends upwardly through the interior of the liquid tank 9 and opens at an upper end in an open space in an upper portion of the liquid tank 9. The pressurized air led through the lines 11 and 12 from the volute casing 6 of the blower 3 to the open space in the upper portion of the liquid tank 9 pressurises the liquid chemical agent 10 in the liquid tank 9 to provide a pressurized liquid chemical agent which flows through an outlet line 13 under pressure to a spray nozzle, not shown, from which it is ejected in atomized particles and scattered by the current of pressurized air ejected through the curved tube 8.

Figure 2:
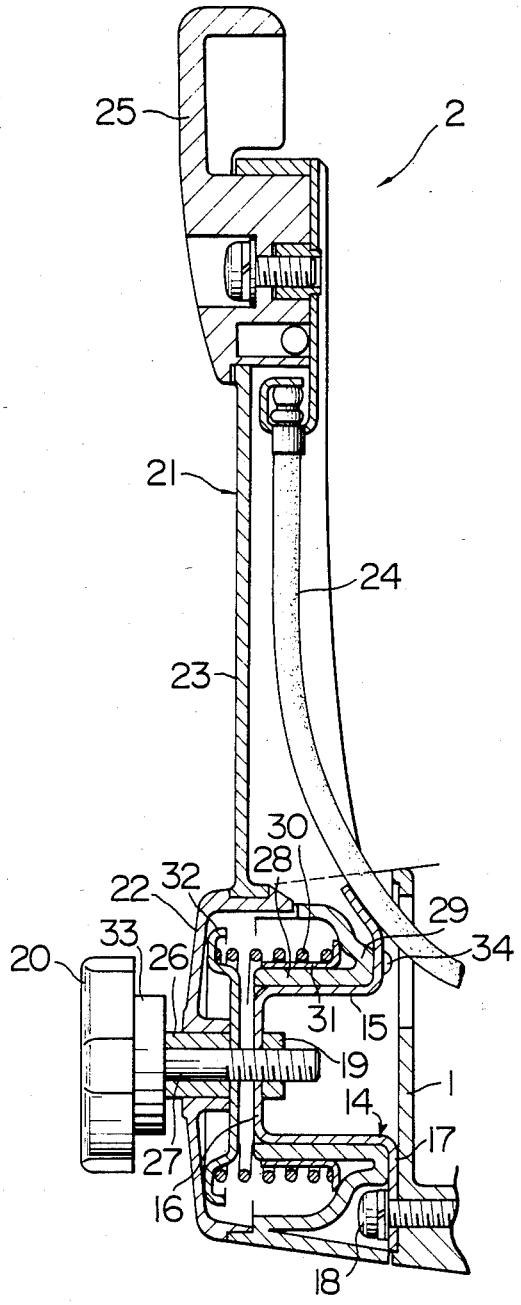
FIG. 2 is a vertical sectional view, on an enlarged scale, of the throttle lever device shown in FIG. 1.

As clearly shown in detail in FIG. 2, the throttle lever device 2 comprises a cup-shaped mounting member 14 including a cylindrical portion 15, a base 16 and a flange 17 and secured at the flange 17 by screws 18 to the main body 1. An internally threaded member 19 is secured to an inner surface of the base 16 of the mounting member 14, and a throttle lever support arm 21 is secured to the mounting member 14 by a fastening member 20 extending through the base 16 and threadably connected to the internally threaded member 19.

The throttle lever support arm 21 includes a boss 22 pivotably connected to the mounting member 14 as presently to be described, an arm member 23 extending radially from the boss 22, and a throttle lever 25 pivotably connected to a forward end of the arm member 23 and connected via a cable 24 to an actuating and control unit, not shown, for the internal combustion engine inside the main body 1 so as to be manipulated by the operator to operate and control the internal combustion engine.

The boss 22 has loosely fitted in a central opening thereof a sleeve 26. The sleeves 26 has a threaded shaft 27 of the fastening member 20 loosely fitted in a bore thereof. The boss 22 includes a cylindrical support member 28 loosely fitted over an outer peripheral surface of the cylindrical portion 15 of the mounting member 14 and pivotably supported thereby, and a rearward end portion 29 positioned against the flange 17 of the mounting member 14. Mounted on an outer periphery of the cylindrical support portion 28 is a spiral compression spring 30 which is supported at one end by a fixed spring seat 31 secured to the cylindrical support portion 28 and rearward end portion 29 and at an opposite end by a movable spring seat 32 loosely fitted over the threaded shaft 27 of the fastening member 20 in a position between the base 16 of the mounting member 14 and the sleeve 26. By this structural arrangement, the movable spring seat 32 is caused to press against an inner end, or a rightward end as seen in FIG. 2, of the sleeve 26, so that the sleeve 26 is held in position by being positioned at an outer end or leftward end against a major diameter portion 33 of the fastening member 20. In the aforesaid construction, as the fastening member 20 is turned to move the sleeve 26 and movable spring seat 32 leftwardly in FIG. 2, the biasing force of the spring 30 causing the rearward end portion 29 of the boss 22 to press against the flange 17 of the mounting member 14 decreases. Thus, the operator can pivotally move the throttle lever device 2 as a whole about the mounting member 14 with respect to the main body 1. Conversely, as the fastening member 20 is turned in an opposite direction to move the sleeve 26 and movable spring seat 32 rightwardly in FIG. 2, the biasing force of the spring 30 increases and causes the rearward end portion 29 of the boss 22 to press harder against the flange 17 of the mounting member 14, making it difficult for the operator to pivotally move the throttle lever device 2.

The rearward end portion 29 of the boss 22 is formed with a projection, not shown, on a surface at which it presses against the flange 17 of the mounting member 14. The flange 17 of the mounting member 14 is formed with a pair of recesses, spaced apart from each other in an arcuate direction, one of which is designated by the reference numeral 34 in FIG. 2. Of the pair of recesses 34, one is positioned such that when the projection formed in the rearward end portion 29 of the boss 22 is brought into engagement therein, the throttle lever support arm 21 is disposed in an upright position as shown in FIG. 1 in which it is substantially parallel to the vertical axis of the main body 1, and the other recess is positioned such that when the projection is brought into engagement therein, the throttle lever support arm 21 extends substantially horizontally forwardly of the main body 1 or in a direction away from the end face thereof disposed beyond the plane of FIG. 1. By this structural arrangement, the throttle lever support arm 21 can be positively held in one of the aforesaid two positions. When the throttle lever support arm 21 is located in the upright position, the space occupied by the machine can be minimized to facilitate storing and transportation; when it is located in a substantially horizontal position, the manipulation of the throttle lever 25 by the operator is facilitated during operations.

While a pair of recesses has been described as being formed in the flange 17 of the mounting member 14, the invention is not limited to this specific number of recesses, and the recesses may be increased in number to increase the positions in which the throttle support arm 21 can be disposed. Alternatively, locking means including a cam or other known member may be used in place of the locking means including the projection and recesses.

What is claimed is:

1. In a power-driven backpack type machine including a main body having an internal combustion engine serving as a power source, a throttle lever device comprising:

a boss pivotably connected to one side of the main body;

an arm extending from the boss;

a throttle lever supported at a forward end of the arm for controlling the operation of the internal combustion engine;

locking means for selectively lockingly securing the boss to the main body in a position in which the arm is upright and substantially parallel to the vertical longitudinal axis of the main body and in a position in which the arm extends forwardly of the main body;

resilient pressing means for forcing the boss against the main body with an adjustable biasing force; and adjusting means for adjusting the biasing force exerted by the resilient pressing means.

* * * * *